United States Patent [19]

Biller et al.

[11] 4,158,830

[45] Jun. 19, 1979

[54] FITTING FOR A CIRCUIT-INTERRUPTING DEVICE

[75] Inventors: Bruce A. Biller, Chicago; Henry W. Scherer, Mt. Prospect, both of Ill.

[73] Assignee: S & C Electric Company, Chicago, Ill.

[21] Appl. No.: 837,241

[22] Filed: Sep. 27, 1977

[51] Int. Cl.[2] ..... H01H 71/20

[52] U.S. Cl. ..... 337/171; 337/190; 337/248

[58] Field of Search ..... 337/171, 180, 190, 248, 337/251, 252, 253

[56] References Cited

U.S. PATENT DOCUMENTS 3,614,700 10/1971 Beard et al. ..... 337/171 X

FOREIGN PATENT DOCUMENTS 1005165 3/1957 Fed. Rep. of Germany ..... 337/248

*Primary Examiner*—George Harris

*Attorney, Agent, or Firm*—John D. Kaufmann

[57] ABSTRACT

An end fitting for a high-voltage fuse is disclosed. A conductive end ferrule of the fuse has an enlargement formed near one end thereof, the enlargement having a shoulder remote from the fuse end which defines an exhaust port. The end fitting has a pair of arms with slots for selectively engaging or disengaging a fuse mounting and an externally threaded collar between the arms. The collar has an aperture with a shoulder on the wall thereof which engages the shoulder on the fuse so that the fuse end protrudes from the collar. The collar mates with an exhaust control device having a threaded bore therethrough. The bore contains a lip designed to engage the fuse end. When the fuse is inserted through the aperture in the collar so that the shoulders engage each other, the exhaust control device may be screwed onto the collar to trap the enlargement shoulder and the fuse end between the collar shoulder and the lip thereby mounting the arms to the fuse and closing the exhaust port with the exhaust control device.

16 Claims, 5 Drawing Figures

FITTING FOR A CIRCUIT-INTERRUPTING DEVICE

BACKGROUND OF THE INVENTION

1. Field of the Invention

The present invention relates to a fitting for a circuit-interrupting device and to apparatus for mounting the fitting to the circuit-interrupting device. More specifically, the present invention relates to an end fitting for a high-voltage fuse unit and to apparatus for mounting the end fitting to the fuse unit.

2. Description of the Prior Art

Fuse units of various constructions are well known. Such fuse units include a fusible element, movable arcing rod (or arcing contact), a body of arc-extinguishing material and mechanisms, such as srings, for biasing the arcing rod toward movement. Normally, the fusible element and the arcing rod are connected between conductive end ferrules on the fuse unit to complete a circuit therebetween. Melting of the fusible element in response to an over-current condition permits the biasing mechanism to move the arcing rod through a bore in the arc-extihguishing material. The interaction between the high-voltage arc thereby struck and the arc-extinguishing material ultimately extinguishes the arc. Fuse units generally include an elongated, insulative, tubular body between the conductive end ferrules for housing the various parts thereof. The end ferrules are attachable to appropriate end fittings which are in turn selectively engageable with or disengageable from appropriate fuse mountings spaced insulatively apart on an appropriate structure. The fuse unit, with the end fittings mounted thereon, is referred to as a fuse.

The prior art recognizes at least two types of fuses, namely, outdoor and indoor. Outdoor fuses generally have end fittings mounted to their fuse units which may be associated with mountings that permit the fuse to dropout upon operation thereof. Specifically, such end fittings and mountings are designed to permit one of the end fittings to rotate in its associated mounting so that the fuse may rotate about the mounting upon operation of the fuse, thus giving a visual indication of fuse operation.

Outdoor fuse operation is generally accompanied by the exhausting or venting of gases from an end of the fuse. The gases may be partially conductive, but this is of little or no concern in outdoor environments since adjacent energized gear is adequately spaced.

Outdoor fuses often contain mechanisms at the exhaust end which prevent the entry of rain or other water into the fuse. Such rain or water may prevent proper operation of the fuse. These facilities may take the form of a rain cap selectively attachable to the exhaust end of the fuse which permits the gases to be vented therefrom upon fuse operation, but which prevent rain and water entry.

Fuses used indoors or in enclosures generally do not operate in a dropout mode. The end fittings and mountings of indoor fuses, however, permit them to be selectively disengaged and engaged at one end upon limited rotation of the other end for replacement of the fuse or other servicing. There is no need for a rain cap or the like in indoor environments since the fuses are usually contained within enclosures or other confined spaces. However, control of the exhaust from the fuse end becomes important in indoor environments where high gas pressures may deleteriously affect enclosures and where gases which may be conductive may adversely affect the insulators of, or the insulating space between, adjacent energized gear. Accordingly, indoor fuses usually have exhaust control facilities which control both the pressure of gases exhausted from the fuse and the contents of such gases.

Because outdoor and indoor fuses are used in different environments, and because the mountings and end fittings of these two fuse types are generally different, prior art fuse units have been divergent in construction and structure, depending on their intended environment of use, even though they have similar voltage and current ratings.

It would be an improvement over the prior art to provide a single universal fuse unit usable with varying end fittings which permit the same fuse unit to be placed in indoor or outdoor environments. Moreover, it would be an improvement over the prior art to provide an indoor fuse unit end fitting which is simple to construct and to assemble to the fuse unit. Such an end fitting should have a minimum of parts, should be easy to manufacture, and should conveniently adapt the universal fuse unit to indoor usage.

SUMMARY OF THE INVENTION

Accordingly, an object of the present invention is the provision of a fitting for a circuit-interrupting device, and more specifically, an end fitting for a high-voltage fuse.

Another object of the present invention is the provision of apparatus for mounting a fitting to a circuit-interrupting device and, more specifically, for mounting an end fitting to a high-voltage fuse.

Yet another object of the present invention is the provision of an end fitting for a high-voltage fuse which permits easy adaptation of a universal fuse unit to indoor use.

Another object of the present invention is the provision of an indoor end fitting for a high-voltage fuse which is simple in construction and is easy to mount to a fuse unit and which contains a minimum number of reusable parts.

With these and other objects in view, the present invention relates to an apparatus for mounting a fitting to an elongated circuit-interrupting device. The fitting includes a first facility carried thereby for engaging a portion of the device to limit the relative movement of the device and the first facility along a central axis of the device. A second facility, attachable to the first facility, clamps the device portion between the two facilities along the axis of the device to mount the fitting to the device.

In a preferred embodiment, the fitting is an end fitting and the circuit-interrupting device is a high-voltage fuse. The device portion is an enlarged section of the fuse having opposed ends, one of which may be an end of the fuse. The first facility is an externally threaded collar having an aperture therethrough with a shoulder therewithin which engages the end of the enlarged fuse section remote from the fuse end. The second facility is an exhaust control device having a threaded bore threadingly engageable with the threaded collar, and a lip within the bore for engaging the fuse end. When the collar and the exhaust control device are threadingly engaged, the enlarged section of the fuse and the fuse end are clamped between the shoulder in the collar aperture and the lip in the exhaust control device bore for mounting the end fitting to the fuse. The end fitting preferably includes an arm connected to the collar which contains facilities, male or female, selectively engageable with an appropriate fuse mounting.

DETAILED DESCRIPTION OF THE INVENTION

Figure 1:
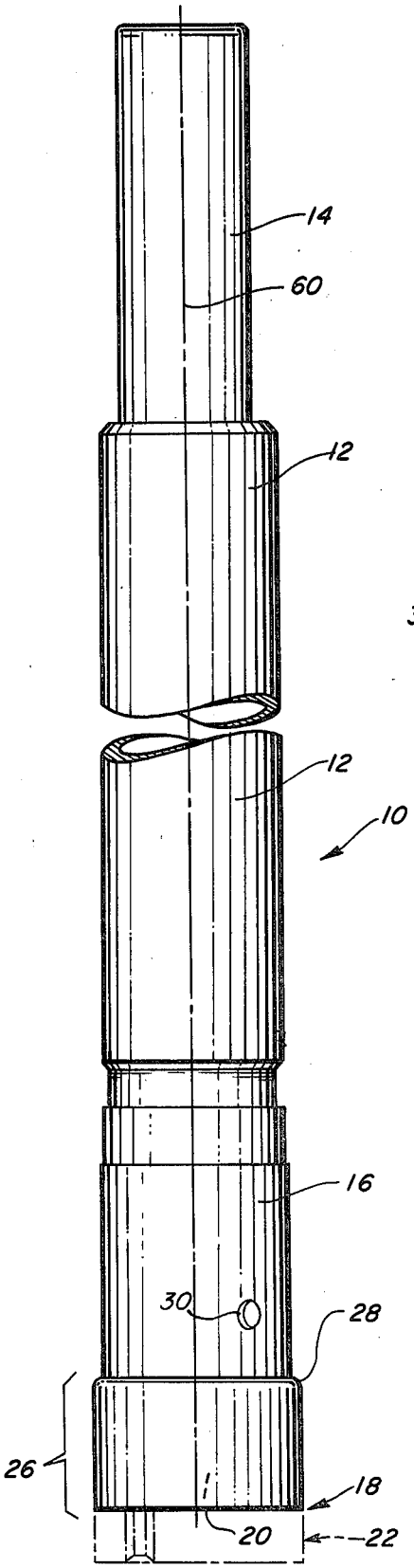
FIG. 1 is a side elevation of a fuse unit with which the present invention is usable.

Referring first to FIG. 1, there is shown a type of fuse unit 10 with which the present invention is usable. The fuse unit 10 may include a tubular elongated insulative body 12 which houses various internal parts such as a fusible element, an arcing rod or arcing contacts, a body of arc-extinguishing material and springs or the like, none of which are shown. At either end of the body 12 are conductive ferrules 14 and 16. The ferrules 14 and 16 are electrically connected to the internal parts of the fuse 10 for normally completing a circuit therethrough, as is well known. Appropriate end fittings are attachable to the ferrules 14 and 16. The end fittings are selectively engageable with and disengageable from appropriate fuse mountings for the fuse unit 10. The end fittings and the mountings may adapt the fuse unit 10 for use in outdoor or indoor environments. Although the fuse unit 10 may be mounted in any position, the ferrule 14 is typically referred to as an upper ferrule and the ferrule 16 is typically referred to as a lower ferrule. The lower ferrule 16 is usually co-terminal with an end 18 of the fuse unit 10. At the fuse unit end 18, as is well known, there is usually an exhaust port 20 from which gases vent upon operation of the fuse unit 10.

The fuse unit 10 may be a type incorporating the inventions disclosed in the following commonly-assigned, co-pending U.S. patent applications: Ser. No. 741,028 (now U.S. Pat. No. 4,109,227 issued Aug. 22, 1978), Ser. No. 740,930, Ser. No. 741,027, Ser. No. 741,026 (now U.S. Pat. No. 4,075,755 issued Feb. 28, 1978), and Ser. No. 741,015 (now U.S. Pat. No. 4,103,270 issued July 25, 1978) all filed Nov. 11, 1976. The fuse unit 10 may also incorporate the invention disclosed and claimed in commonly-assigned U.S. Pat. No. 4,045,758 issued June 30, 1977.

In outdoor environments, the exhaust port 20 at the fuse unit end 18 may be closed by a rain cap 22 which permits the venting of gases therefrom but which prevents the entry of water into the fuse unit 10, as disclosed and claimed in commonly-assigned U.S. Pat. No. 4,047,142 issued Sept. 6, 1977. In indoor environments, the rain cap 22 is removable from the fuse unit end 18, and mounted to the fuse unit end 18 may be an exhaust control device 24 (FIG. 4) which may be of the type described and claimed in commonly-assigned U.S. Pat. Nos. 4,001,753 issued Jan. 4, 1977, 3,965,452 issued June 22, 1976, and 3,719,912 issued Mar. 6, 1973.

In accordance with the descriptions of the above-described, commonly-assigned U.S. patent applications and patents, and with the principles of the present invention, a portion of the fuse unit 10 preferably contains an enlarged section or enlargement 26 at or near the end 18 thereof. Preferably, the diameter of the enlarged section 26 is formed in the end ferrule 16 and has a greater diameter than the remainder of the ferrule 16 and the body 12 of the fuse unit 10. At the transition between the two diameters, there is defined a shoulder 28 on the ferrule 16, which is one end or surface of the enlarged section 26, the other end or surface being the fuse unit end 18. The ferrule 16 may include a locating stud 30 for a purpose to be described below.

The body 12 of the fuse unit 10 and the ferrule 16 are depicted as cylindrical as is the enlarged section 26, the shoulder 28 taking the form of an annular shoulder about the fuse unit 10. Shapes other than cylindrical are contemplated, however, and the enlargement and section may have other configurations than that shown. Specifically, although the enlarged section 26 is shown as being defined by the annular shoulder 28 and the circular fuse unit end 18, such enlarged section 26 may be defined by other surface features of the fuse unit 10. For example, as described in more detail below, the enlarged section 26 may comprise a stud or protrusion, a plurality of studs or protrusions, surface features or irregularities or the fuse unit 10, or the like, in any combination or permutation with each other or with the shoulder 28 and fuse unit end 18 shown. Thus, the important feature of the enlarged section is that the ends or surfaces thereof (here the shoulder 28 and the fuse unit end 18) be separated generally along the fuse unit 10.

Moreover, the enlarged section 26 may be anywhere on the fuse unit 10, i.e., on the body 12, the ferrule 14 or the ferrule 16.

Figure 2:
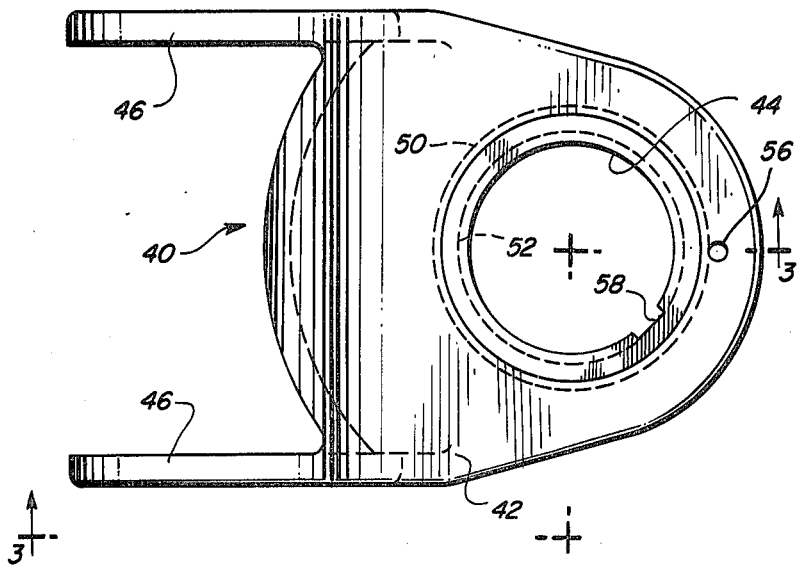
FIG. 2 is a top view of a trunnion assembly mountable to the fuse unit, in accordance with the principles of the present invention, which permits selective engagement with an disengagement from appropriate fuse mounting.
Figure 3:
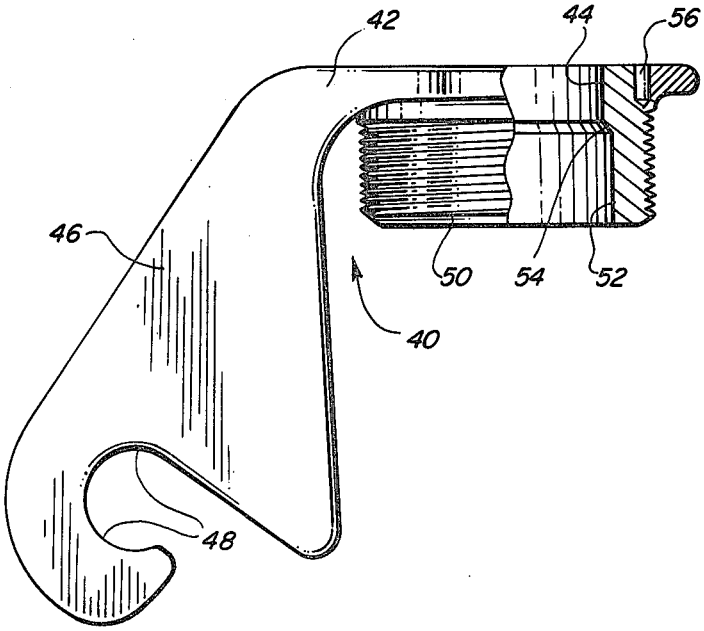
FIG. 3 is a side, elevational, partly sectional view of the trunnion assembly shown in FIG. 2.

Referring now to FIGS. 2 and 3, there is shown a preferred trunnion assembly 40 in accordance with the principles of the present invention. The trunnion assembly 40 includes a main body 42 having an aperture 44 therethrough. Extending from the main body portion 42 on either side thereof are legs 46. As depicted, the legs 46 include a slot 48 or other female feature which is selectively engageable with a pin or other complementary structure on a fuse mounting (not shown) to permit both selective engagement and disengagement of the legs 46 and the fuse mounting as well as rotation of the legs 46 about the fuse mounting. The legs 46 may alternatively include a male feature, such as a stud or pin (not shown), which may similarly cooperate with a slot or other female feature in the fuse mounting. The engageable/disengageable/rotatable relationship between the legs 46 and the fuse mounting permits rotation of the fuse unit 10 about the lower ferrule 16. If the present invention is used with the upper ferrule 14, the legs 46 will take other forms or may not be present at all.

Depending from the main body 42 of the trunnion assembly 40 is an externally threaded collar 50. The collar 50 has an aperture 52 therethrough which is coaxial and continuous with the aperture 44 through the main body 42. Preferably, the diameter of the aperture 52 is larger than the diameter of the aperture 44. The intersection of the two apertures 44 and 52 defines a shoulder 54 centrally of the trunnion assembly 40. The diameter of the aperture 44 is generally equal to the diameter of the fuse unit 10 and the ferrule 16 above the enlarged section 26, while the diameter of the aperture 52 is generally equal to the diameter of the enlarged section 26. The fuse unit 10 is receivable in the apertures 44 and 52 so that the aperture 44 is conformal with the fuse body 12 and to the smaller diameter portion of the ferrule 16 while the aperture 52 is conformal with the enlarged portion 26. The fuse unit 10 is receivable in the apertures 44 and 52 until the shoulder 28 of the enlarged section 26 abuts and is engaged by the shoulder 54. Following this engagement, relative movement of the trunnion assembly 40 and of the fuse unit 10 in the direction of insertion, i.e., along the fuse unit 10, is prevented (see FIG. 5).

The collar 50 may be formed integrally with the main body 42 or may be a separate member attached, as by threading, to the main body 52. In the event that the collar 50 and the main body portion 42 are separate threaded-together elements, a pin 56 may be used to fix their rotational relationship.

The aperture 44 may inlude in the wall thereof a notch 58 which is entered by the locating stud 30. The entering of the stud 30 into the notch 58 fixes the rotational relationship of the fuse unit 10 once it is inserted through the apertures 44 and 52. This, of course, fixes the position of the fuse unit 10 with respect to the legs 46. A similar arrangement may be used at or near the ferrule 14 of the fuse unit 10 for an upper end fitting (not shown) to rotationally fix the position of such upper end fitting and the trunnion assembly 40 about the fuse unit 10.

As should be clear, the collar 50 and the main body 42 may take other forms, as may the apertures 44 and 52 and the shoulder 54. Neither the collar 50 nor the main body 42 need completely encircle the fuse unit 10; each may also be in several parts which are assembled about the fuse unit 10. The fuse unit 10 may be associated with the collar 50 and the body 42 by transverse insertion through a passageway in the side of one or both of them. Moreover, the apertures 44 and 52 and the shoulder 54 may take any form complementary to the form of the enlarged section 26 and its ends or surfaces 18 and 28. Specifically, where the enlarged section 26 takes a form or shape different from that depicted, different facilities will be provided in the trunnion assembly 40 for fixing the trunnion assembly 40 to the fuse unit 10. Should the enlarged section 26 take the form of a stud as described earlier, the apertures 44 and 52 may be so configured as to engage this stud at one end or surface thereof relative to a central axis 60 of the fuse unit 10. The important relationship of the trunnion assembly 40 to the fuse unit 10 is that the trunnion assembly 40 may be mounted to the fuse unit 10, but at some location thereof along the axis 60, the position of the trunnion assembly 40 with respect to the end 18 of the fuse unit 10 is fixed by the engagement of the enlarged section or other feature on the fuse unit 10 and a feature within or on the trunnion assembly 40. Generally speaking, such engagement is along the axis 60 of the fuse unit 10 or, stated differently, longitudinally of the fuse unit 10.

Figure 4:
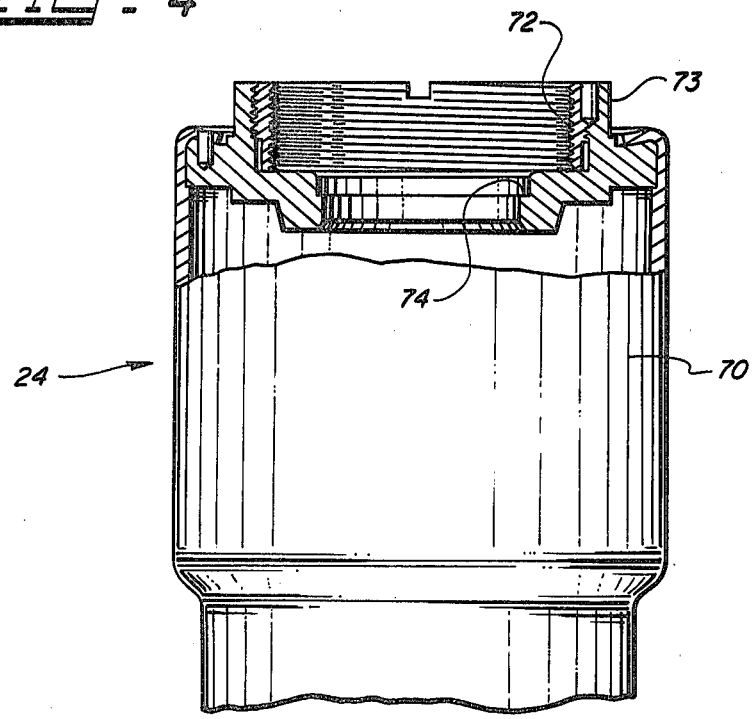
FIG. 4 depicts an exhaust control device which may be associated with an end of the fuse unit of FIG. 1, and which may be attached to the trunnion assembly of FIGS. 2 and 3 for mounting both the exhaust control device and the trunnion assembly to the fuse unit in FIG. 1.

Turning now to FIG. 4, there is shown the exhaust control device 24 of the preferred form according to the principles of the present invention. A body 70 of the exhaust control device 24 contains facilities (not shown) for controlling and moderating the gas vented from the exhaust port 20 at the end 18 of the fuse unit as described in the above-referenced U.S. patents. Communicating with the interior of the body 70 is a bore 72 formed through a rim 73 integral with the body 70. The rim 73 and the body 70 may be separately formed and mutually attached. The bore 72 has its walls threaded so that it may threadingly engage the collar 50. An internal portion of the bore 72 defines a lip 74 which is smaller in diameter than the end 18 of the fuse unit 10. The diameter of the bore 72 immediately above the lip 74 is generally equal to the diameter of the enlarged section 26 of the ferrule 16.

It is not necessary to the present invention that the exhaust control assembly 24 be used. Specifically, a member similar to or the same as the rim 73 and having threads engageable with the threads of the collar 50 may be used without the exhaust control device 24 or with a different device attached thereto. Moreover, the rim 73 and the collar 50 need not be threaded as shown or may be not threaded at all, other modes of mutual attachment being contemplated.

In the preferred embodiment, where the ferrule 16 is conductive, the trunnion assembly 40 and the exhaust control device 24 may also be of a conductive material. Such, of course, is not necessary.

Figure 5:
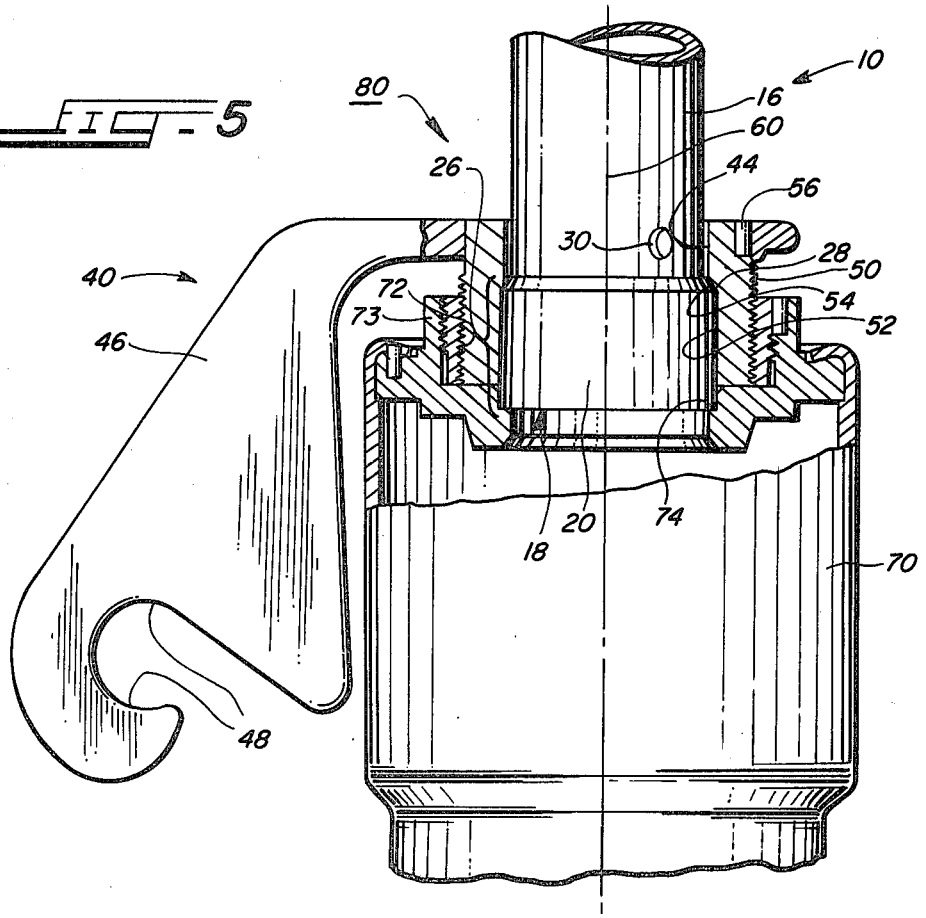
FIG. 5 is a side, elevational, partly sectional view showing the trunnion assembly of FIGS. 2 and 3 and the exhaust control device of FIG. 4 mounted to the fuse unit of FIG. 1 in accordance with the principles of the present invention.

Turning now to FIG. 5, there is shown the trunnion assembly 40 and the exhaust control device 24 attached to the fuse unit 10 to produce a preferred, specific end fitting 80 according to the present invention. The fuse unit 10 is inserted through the apertures 44 and 52 until the shoulder 28 abuts the shoulder 54. Then, the end 18 of the fuse unit 10 is inserted into the bore 72 of the exhaust control device 24 near the lip 74. Next, the exhaust control device 24 is rotated about the collar 50 so that the threads engage and the exhaust control device 24 is threaded onto the collar 50. This has the effect of trapping or clamping the enlarged section 26 between the shoulder 54 and the lip 74. Specifically, the shoulder 28 of the enlarged section 26 bears against the shoulder 54 of the trunnion assembly 40, while the fuse end 18 bears against the lip 74. Continued threading of the exhaust control device 24 onto the collar 50 ultimately compresses the fuse unit end 18 and the shoulder 28 toward each other, thereby clamping the enlarged section 26 therebetween. After the exhaust control device 24 is firmly fixed to the trunnion assembly 40, the fuse unit 10 may be selectively engaged with or disengaged from a mounting which appropriately matches the slot 48 (or other feature) of the legs 46.

As can be seen, a simple, easy-to-construct end fitting 80 for the fuse unit 10 has been provided by the trunnion assembly 40 and the exhaust control device 24, which acts in the nature of a large nut with respect to the threaded collar 50. No additional parts or assemblies are necessary to adapt the fuse unit 10 for appropriate insertion into an indoor fuse mounting. In the event the enlarged section 26 takes the form of a stud or other surface feature of the fuse unit 10, the exhaust control device 24 or the bore 72 thereof will contain a similar mating feature for engaging this stud axially of the fuse unit 10 opposite from the engagement of the trunnion assembly 40 with its mating feature of the fuse unit 10.

The end fitting 80 just described may be utilized at either end of the fuse unit 10. Moreover, the legs 46 may be replaced by other facilities, depending on the nature of the fuse mounting with which the end fitting 80 is to cooperate.

It should be noted that the above arrangement wherein the exhaust control device 24 is used to attach the trunnion assembly 40 to the fuse unit 10 automatically closes the end 18 of the fuse unit 10 and directs the exhaust port 20 into the exhaust control device 24. Accordingly, the simple and efficient end fitting 80 described achieves both convenient mounting of the fuse unit 10 and control of the exhaust thereof with a minimum of parts.

Although certain specific embodiments of the invention are described in the foregoing description, it should be understood that this invention is not limited to those specific embodiments and is capable of modification and rearrangement. For example, the fuse unit 10 may take the form depicted or other forms, and may be another type of circuit-interrupting device. The trunnion assembly 40 and the exhaust control device 24 may be made of a conductive material or other materials. Moreover, the exhaust control device 24 need not be used, and a large threaded member may be used in its place. Additionally, the end fitting 80 may be located at any position on the fuse unit 10 or other circuit-interrupting device. Also, as discussed previously, the enlarged section 26 need not take the form shown, and may take the form of a stud or other surface feature of the body 12 of the fuse unit 10. The important relative relationship of the trunnion assembly 40 and the exhaust control device 24 is that they capture and clamp the enlarged section 26 therebetween by exerting a clamping force thereagainst which is generally parallel to the axis 60 of the fuse unit 10, or, is generally longitudinal of the fuse unit 10.

We claim:

1. Apparatus for mounting a fitting to a circuit-interrupting device having a central axis, the device being selectively placeable in a mounting therefor, comprising first means carried by the fitting for engaging a portion of the device about the axis thereof to limit relative movement of the device and the first means along the axis;

second means attachable to the first means for clamping the device portion therebetween along the axis to mount the fitting to the device; and third means carried by the fitting for selectively engaging and disengaging the device mounting.

2. The apparatus of claim 1, wherein the device is a fuse and the fitting is mounted to the exterior of the fuse, and wherein the device portion is an enlarged section of the fuse having opposed first and second surfaces;

the first means engages the first surface of the enlarged section; and the second means engages the second surface of the enlarged section.

3. The apparatus of claim 2, wherein one of the enlarged fuse section surfaces is an end of the fuse.

4. The apparatus of claim 3, wherein the fuse end defines an exhaust port; and one of the first or second means carries an exhaust control device which closes the exhaust port when the first and second means are attached.

5. The apparatus of claim 4 wherein the second surface of the enlarged fuse section is the end of the fuse, and wherein the first surface of the enlarged fuse section is a first shoulder formed on the fuse remote from the fuse end and about the axis;

the first means comprises an externally threaded collar having an aperture therethrough for receiving the fuse and the first shoulder, and a second shoulder in the aperture for engaging the first shoulder of the fuse received in the aperture; and the second means carries the exhaust control device and comprises a threaded bore in the exhaust control device threadingly attachable to the threaded collar for receiving the fuse end, and a lip in the threaded bore for engaging the received fuse end, to clamp the first shoulder and the fuse end between the second shoulder and the lip.

6. The apparatus of claim 3, wherein the first surface of the enlarged fuse section is a protruding feature on the fuse remote from the fuse end;

one of the first or second means comprises a threaded collar having an aperture therethrough for receiving the fuse, and a shoulder on the collar for engaging the protruding feature of the fuse received in the aperture; and the other of the first or second means comprises a threaded member threadingly attachable to the threaded collar and having a bore for receiving the fuse, and a lip on the member for engaging the end of the fuse received in the bore to clamp the protruding feature in the fuse and between the shoulder and the lip.

7. The apparatus of claim 6, wherein the fuse end defines an exhaust port; and one of the first and second means comprises an exhaust control device which closes the exhaust port when the first and second means are attached.

8. The apparatus of claim 7, wherein the collar is carried by the first means, and the shoulder is within the aperture; and the threaded member is carried by the second means and is integral with the exhaust control device, and the lip is within the bore.

9. The apparatus of claim 8, wherein the collar is externally threaded, the bore of the threaded member is internally threaded; and the fuse end protrudes beyond the collar when the shoulder engages the protruding feature.

10. The apparatus of claim 8, wherein the protruding feature is a raised shoulder about the fuse, the collar is integral with the fitting, and the third means comprises a leg depending from the fitting having a slot therein.

11. The apparatus of claim 1, wherein the fitting is an end fitting;

the device is a fuse;

the device portion is an enlarged section of the fuse terminating at an end thereof;

the first means engages the enlarged section remotely from the fuse end; and the second means engages the fuse end.

12. The apparatus of claim 11, wherein the enlarged fuse section has an exhaust port;

the second means comprises an exhaust control device which closes the exhaust port.

13. The apparatus of claim 12, wherein the first means comprises an externally threaded collar having an aperture therethrough, a first part of which in conformal with the fuse, a second part of which is conformal with the enlarged section, the intersection of the first and second aperture parts defining a shoulder which rests against the enlarged section so that the fuse end protrudes beyond the collar; and the second means comprises a bore in a wall of the exhaust control device, the bore having a first threaded part rotatably engageable with the collar threads and a lip engageble with the fuse end, sufficient rotation of the exhaust control device about the collar clamping the enlarged section and the fuse end between the shoulder and the lip.

14. Apparatus for attaching an end fitting to an end of a circuit interrupting device, the device being selectively placeable in a mounting therefor, comprising:

means carried by the end fitting for surrounding at least a portion of the circumference of the device near the end thereof;

means for selectively engaging and disengaging the fuse mounting;

means for limiting the movement of surrounding means toward the device end so that the device end protrudes beyond the surrounding means, and means mountable to the surrounding means for clamping the protruding device and between the surrounding means in the clamping means to attach the end fitting to the device end.

15. Apparatus for attaching an end fitting to an end of a circuit-interrupting device, the device being selectively placeable in a fuse mounting, comprising;

first means carried by the end fitting for surrounding at least a portion of the circumference of the device near the end thereof, and for limiting the movement of the device and relative thereto so that the device end protrudes therebeyond;

second means mountable to the first means for clamping and protruding device and between the first and second means to attach the end fitting to the device end; and third means for selectively engaging and disengaging the device mounting.

16. Apparatus for mounting a fitting to an elongaged circuit-interrupting device, the device being selectively placeable in a mounting therefor, comprising first means carried by the fitting for engaging a portion of the device to limit relative movement of the device and the first means longitudinally of the device, second means attachable to the first means for clamping the device portion therebetween longitudinally of the device to mount the fitting to the device; and third means for selectively engaging and disengaging the device mounting.

* * * * *